US005591005A

United States Patent [19]

McCready

[11] Patent Number: 5,591,005

[45] Date of Patent: Jan. 7, 1997

[54] CEILING FAN BLADE COVER

[76] Inventor: Dennis McCready, 13223 Hazelwood Ave., Lakewood, Ohio 44107

[21] Appl. No.: 511,456

[22] Filed: Aug. 4, 1995

[51] Int. Cl.[6] ..... F04D 29/70

[52] U.S. Cl. ..... 416/62; 416/5; 416/146 R; 112/475.08

[58] Field of Search ..... 416/146 R, 62, 416/5; 112/475.08, 10, 470.31

[56] References Cited

U.S. PATENT DOCUMENTS

| | | | |
|---|---|---|---|
| 4,676,721 | 6/1987 | Hardee | 416/146 R X |
| 4,832,572 | 5/1989 | Prucha et al. | 416/62 X |
| 5,110,261 | 5/1992 | Junkin | 416/62 |
| 5,281,093 | 1/1994 | Sedlak et al. | 416/62 |

*Primary Examiner*—Edward K. Look
*Assistant Examiner*—Michael S. Lee
*Attorney, Agent, or Firm*—Roger D. Emerson

[57] ABSTRACT

A fan blade cover for a fan blade of a ceiling fan includes a casing having an outer edge defining a main body. The main body has an outside surface and an inside surface. The outer edge of the main body is folded over toward the inside surface and is attached to the inside surface of said main body, thereby creating a passage. An elastic band is threaded through the passage. The cover further includes hook and loop fasteners which are attached to the casing in a manner so as to selectively fix the fan blade cover to the fan blade. The invention also includes a method of constructing a fan blade cover for a fan blade of a ceiling fan, the method including the steps of cutting a casing, the casing having an outer edge and a main body, the main body having a outside surface and an inside surface; folding over the outer edge of the casing toward the inside surface, thereby creating a passage, attaching the outer edge to the main body, and, threading an elastic band through said passage.

10 Claims, 2 Drawing Sheets

CEILING FAN BLADE COVER

BACKGROUND OF THE INVENTION

1. Field of Invention

This invention pertains generally to the art of decorative covers for the blades of ceiling fans, and more specifically to an improved design to attach such a cover to the fan blade.

2. Description of the Related Art

In the past, fan blade covers for ceiling fan blades have been unnecessarily complicated to assemble and costly to produce because irregular-shaped patterns were used in the assembly process.

In particular, one newer design disclosed by U.S. Pat. No. 5,281,093 to Sedlak et al. typifies the complex pattern problem. The '093 patent discloses a cover cut from an irregular-shaped pattern that requires careful and time-intensive assembly of the ceiling fan blade cover.

Further, covers for other types of articles such as sporting equipment and vehicles all employ the use of complex patterns that require greater time and cost in the assembly process. The applicant recognized the need for a low cost ceiling fan blade cover produced from a simple pattern.

The present invention contemplates a new and improved ceiling fan blade cover which is simple in design, effective in use, and overcomes the foregoing difficulties and others while providing better and more advantageous overall results.

SUMMARY OF THE INVENTION

In accordance with the present invention, a new and improved fan blade cover is provided which protects the fan blades of ceiling fans.

More particularly, in accordance with the present invention, the fan blade cover for a fan blade of a ceiling fan and which the fan blade is connected to a fan housing by a fan stem, the fan blade cover comprises a casing, the casing having an outer edge and a main body, the main body having an outside and an inside, the outer edge being folded over toward the inside and attached to the main body, creating a passage; an elastic band, the elastic band being threaded through the passage; and, fastening means, the fastening means being attached to the casing in a manner as to fix the fan blade cover to the fan blade.

According to one aspect of the invention, the fan blade cover for a fan blade of a ceiling fan and which the fan blade is connected to a fan housing by a fan stem, the fan blade cover comprising a main body and at least one hook and loop fastener, the at least one hook and loop fastener having a first part and a second part, the first part being attached to the main body, the second part being attached to the main body, and the first part and the second part sticking together when coming into contact with one another.

According to another aspect of the invention, a method of constructing a fan blade cover for a fan blade of a ceiling fan comprising the steps of: providing a casing, the casing having an outer edge and a main body, the main body having a outside and an inside; folding over the outer edge of the casing toward the inside, creating a passage; attaching the outer edge to the main body; providing an elastic band; threading the elastic band through the passage; providing fastening means; and, attaching the fastening means to the casing.

One advantage of the present invention is its use of a simple pattern for the ceiling fan blade cover.

Another advantage of the present invention is its ability to be quickly and easily assembled.

Another advantage of the present invention is its low cost to produce.

Another advantage of the present invention is its ability to be matched to other fixtures in the room that has the ceiling fan such as curtains.

Another advantage of the present invention is the ability to easily cover the ceiling fan blade with the cover.

Another advantage of the present invention is the use of hook and loop to ease the process of using the ceiling fan cover by making installation simple.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts. A preferred embodiment of these parts will be described in detail in the specification and illustrated in the accompanying drawings, which form a part of this disclosure and wherein.

DESCRIPTION OF THE PREFERRED EMBODIMENT

The invention has been described with reference to the preferred embodiment. Obviously, modification and alterations will occur to others upon a reading and understanding of the specification. It is intended by the applicant to include all such modifications and alterations insofar as they come within the scope of the appended claims or the equivalents thereof.

Figure 1:
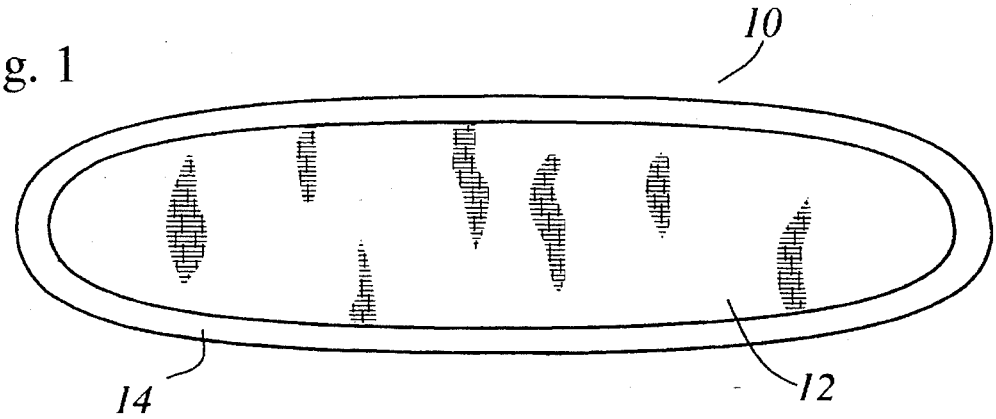
FIG. 1 shows an unassembled ceiling fan blade cover.

Referring now to the drawings, FIG. 1 shows the oval-shaped fabric pattern of the cover 10. The cover 10 has a main body 12 that is preferably a flexible material that is designed to match other household or business fixtures such as curtains. The cover 10 also has an outer edge 14. The outer edge 14 may be comprised of the same material as the main body 12, or, as in the preferred embodiment, may be a different material that is more suitable for being sewn. The size of the cover 10 is variable depending on the size of the ceiling fan blade to be covered. In a preferred embodiment of the present invention, the oval-shape of the cover 10 has a maximum length of approximately 2.0 feet and a maximum width of approximately 9.0 inches.

Figure 2:
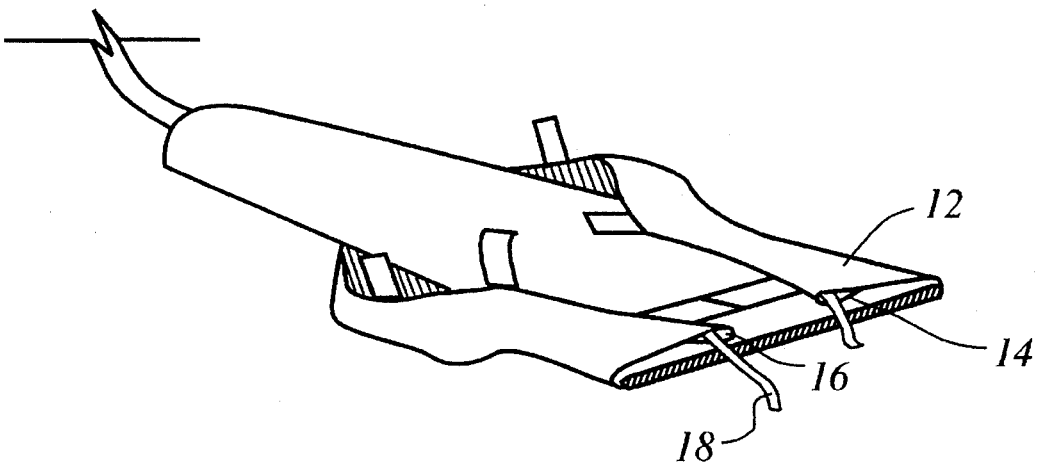
FIG. 2 shows a cross-section of a ceiling fan blade cover.

FIG. 2 shows a cross-section of an assembled cover 10. During assembly, approximately 0.5 inch of the outer edge 14 is folded over and preferably sewn to the main body 12. This creates a passage 16. An elastic band 18 is threaded through the passage 16, which causes the outer edge 14 to contract. The contraction of the outer edge 14 allows the cover 10 to easily fit around a ceiling fan blade (not shown).

Figure 3:
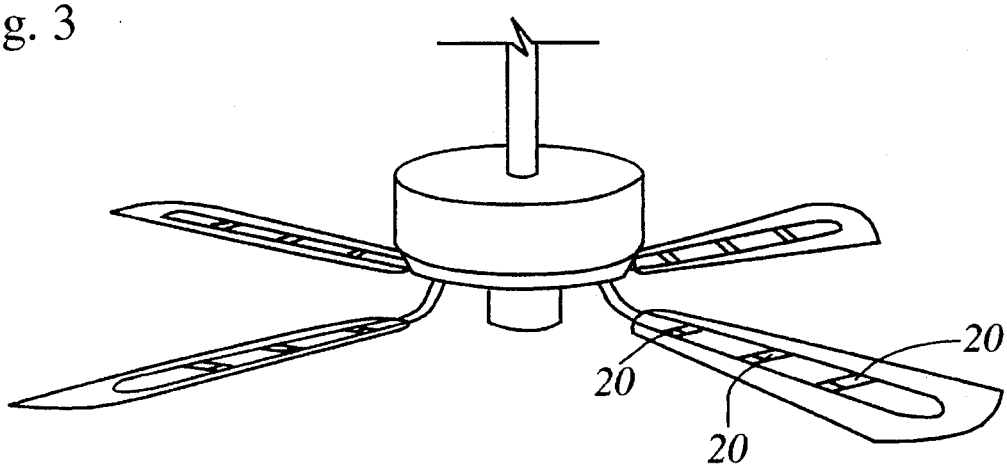
FIG. 3 shows a top view of an assembled ceiling fan blade cover.

FIG. 3 shows a top-view of the assembled ceiling fan blade cover 10. Fasteners 20, preferably made of the "hook and loop" variety, are attached to the main body 12 near the outer edge 14 to enable the cover 10 to be secured to a ceiling fan blade (not shown). The preferred hook and loop fasteners are sold under the registered trademark Velcro®.

Figure 4:
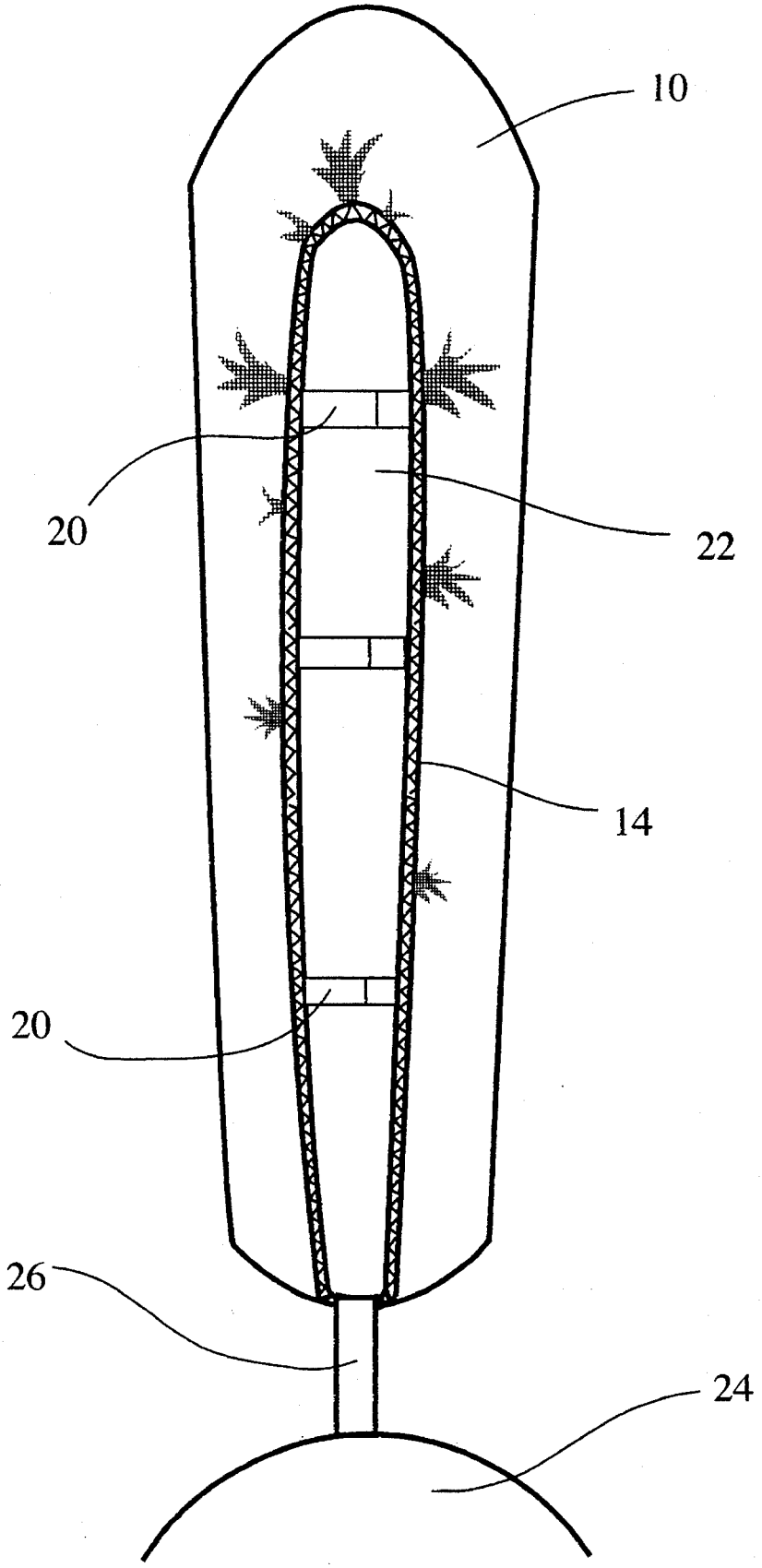
FIG. 4 shows a ceiling fan blade cover mounted on a ceiling fan blade.

FIG. 4 shows a cover 10 covering a ceiling fan blade 22, which is attached to a fan housing 24 by a fan stem 26. The fasteners 20 and the elastic band (not shown, see FIG. 2) around the outer edge 14 ensure that the cover 10 will not fall off of the ceiling fan blade 22.

Having thus described the invention, it is now claimed: What is claimed is:

1. A fan blade cover for a fan blade of a ceiling fan, the fan blade being connected to a fan fan housing by a fan fan stem, said fan blade cover comprising:

a casing, said casing having an outer edge defining a main body, said main body having an outside surface and an inside surface, said outer edge being folded over toward said inside surface, and attached to said inside surface of said main body, thereby creating a passage;

an elastic band, said elastic band being threaded through said passage; and, fastening means, said fastening means being attached to said casing in a manner as to selectively fix said fan blade cover to the fan blade.

2. The fan blade cover of claim 1 wherein said casing is oval-shaped.

3. The fan blade cover of claim 2 wherein said outer edge of said casing is sewn to said main body.

4. The fan blade cover of claim 3 wherein said casing is fabricated from a flexible material that fits around the fan blade.

5. The fan blade cover of claim 4 wherein said casing is fabricated from a decorative material.

6. The fan blade cover of claim 5 wherein said fastening means comprises at least one hook and loop fastener, said at least one hook and loop fastener having a first part and a second part, said first part being attached to said main body, said second part being attached to said main body, and said first part and said second part sticking together when coming into contact with one another.

7. The fan blade cover of claim 6 wherein said at least one hook and loop fastener comprises three hook and loop fasteners.

8. A method of constructing a fan blade cover for a fan blade of a ceiling fan, said method comprising the steps of:

cutting a casing, said casing having an outer edge and a main body, said main body having an outside surface and an inside surface, said casing being oval-shaped, said casing being made of a flexible material;

folding over said outer edge of said casing toward said inside surface, thereby creating a passage;

attaching said outer edge to said main body;

threading an elastic band through said passage;

sewing said outer edge to said main body; and, securing attaching means to said casing said casing attaining the size and shape of said fan blade when completed.

9. The method of constructing a fan blade cover of claim 8 wherein said attaching means is a one hook and loop fastener.

10. The method of constructing a fan blade cover of claim 9 further comprising the steps of providing three hook and loop fasteners and attaching said three hook and loop fasteners to said main body.

* * * * *